US005349993A

United States Patent [19]

Casey

[11] Patent Number: 5,349,993

[45] Date of Patent: Sep. 27, 1994

[54] BEVERAGE DISPENSING APPARATUS AND RETROFITTING KIT

[75] Inventor: Joseph B. Casey, St. Louis, Mo.

[73] Assignee: Polster, Lieder, Woodruff & Lucchesi, LC., St. Louis, Mo.

[21] Appl. No.: 959,963

[22] Filed: Oct. 13, 1992

[51] Int. Cl.[5] ..... B65B 3/04; B67C 3/00

[52] U.S. Cl. ..... 141/94; 141/141; 141/198; 141/360; 222/52

[58] Field of Search ..... 141/94, 95, 96, 141, 141/198, 360; 4/304, 623; 222/52, 63

[56] References Cited

U.S. PATENT DOCUMENTS

| | | | |
|---|---|---|---|
| 2,727,670 | 12/1955 | Shore | 141/351 X |
| 4,202,387 | 5/1980 | Upton | 141/360 |
| 4,261,397 | 4/1981 | Guy | 141/1 |
| 4,559,979 | 12/1985 | Koblasz et al. | 141/95 X |
| 4,572,253 | 2/1986 | Farmer et al. | 141/95 |
| 4,670,010 | 6/1987 | Dragone | 604/289 |
| 4,784,193 | 11/1988 | Schmied et al. | 141/198 |
| 4,823,414 | 4/1989 | Piersimoni et al. | 4/623 |
| 4,915,347 | 4/1990 | Iqbal et al. | 251/30.03 |
| 4,917,155 | 4/1990 | Koblasz | 141/1 |
| 4,946,070 | 8/1990 | Albert et al. | 222/52 |
| 4,953,236 | 9/1990 | Lee et al. | 4/194 |
| 4,967,935 | 11/1990 | Celeste | 222/63 |
| 4,984,314 | 1/1991 | Weigert | 4/663 |
| 5,036,892 | 8/1991 | Stembridge et al. | 141/1 |

*Primary Examiner*—Ernest G. Cusick

*Attorney, Agent, or Firm*—Polster, Lieder, Woodruff & Lucchesi

[57] ABSTRACT

Apparatus (10) for dispensing a potable beverage (B) stored in a container (K). A tap (16) is attached to the container and provides a discharge passage (18) for the beverage. A valve (20) opens and close the passage. A valve control unit (32) operates the valve. The container is a pressurized container and the valve control unit also utilizes this source (G) of pressure to operate the valve. A controller (60) activates the valve control unit. The controller includes a sensor (64) for first sensing when a receptacle is positioned adjacent the tap, to activate the valve control unit, for beverage to be dispensed into the receptacle. The controller subsequently senses when the receptacle has been withdrawn to deactivate the valve control unit and stop dispensing of the beverage. Dispensing is also automatically stopped if the receptacle is left in place for a preselected amount of time. The apparatus is available in a "kit" form for retrofitting existing dispensers. Further, two taps can be arranged in a side-by-side relationship for automatically dispensing beverage into two receptacles simultaneously.

15 Claims, 3 Drawing Sheets

BEVERAGE DISPENSING APPARATUS AND RETROFITTING KIT

BACKGROUND OF THE INVENTION

This invention relates to dispensers for beverages such as beer, soda, and the like and, more particularly, to apparatus usable with such dispensing units for automatically dispensing the beverage when a container is placed beneath the dispenser's tap and to stop dispensing when the container is withdrawn or after a predetermined period of time.

In baseball parks, football stadiums, and similar arenas, the sale of beer and soda is typically done by a concessionaire who contracts with the facility owner and makes his money based on the amount of product he can sell and the cost of selling it. Beer sales, for example, comprise a large part of the concessionaire's business. Consequently, it is most profitable for the concessionaire to dispense as much beer as he can sell. At events that have a large attendance, one drawback in doing this is that beer dispensers typically include manually operated taps which require the bartender to hold the tap open while the beer pours into the cup, mug, or whatever receptacle it is sold in. If the customer orders other things, hot dogs, pretzels, etc. with the beer, the seller has to wait until the beer is dispensed before they can fill the rest of the order. As a result, not as many customers can be served in the short period of time during which the bulk of sales are typically made; i.e. between innings, halftime. This not only effects the concessionaire's profits, but also causes spectators to be unhappy which could effect attendance.

In other settings such as taverns or restaurants, where beverage dispensers are similarly used, the same problem also occurs. Here, a waiter or waitress has to wait until the beverage is dispensed before he or she can do other necessary to complete the customer's service. While this may not ordinarily be a problem, at busy times, slow service means customer complaints and potential loss of business.

Automatic liquid dispensing or fluid flow control units have been previously developed. See, for example, U.S. Pat. Nos. 5,016,786, 5,007,560, 4,979,641, and 4,070,133, all of which are directed to beer dispensing; as well U.S. Pat. Nos. 4,984,314, 4,967,935, 4,953,236, 4,946,070, 4,915,347, 4,823,414, 4,670,010, and 4,111,243 which describe different control schemes for controlling the dispensing of other beverages or liquids. While the liquid dispensing apparatus described in these patents probably function to achieve their intended purpose, none necessarily solve the problems. With beer, for example, a major problem is the making of foam. Some proposed solutions involved having a solenoid through which the beer is flowed to automatically control its flow. However, it has been found that this creates more foaming than is desirable. Another proposed solution has been to leave the beer tap open at all times and automatically open and close the flow line upstream of the tap. This, however, allows dirt and bacteria into the tap and is therefore not acceptable. Additional proposals involve valves, but it has been found that beer leaves a film on the moving member of the valve which can cause the valve to stick, particularly if the dispenser is not used for some time.

SUMMARY OF THE INVENTION

Among the several objects of the present invention may be noted the provision of a hand free, "no-touch" apparatus for dispensing potables such as beer, soda, wine, and similar beverages; the provision of such apparatus which allows the user to automatically dispense the beverage simply by placing a container in proximity to a tap of the dispenser for the beverage; the provision of such a dispenser to allow the user to dispense more than one container of the beverage at the same and to do so while allowing the user to perform other activities at the same time; the provision of such a dispenser which automatically dispenses the beverage only while a container is placed beneath the tap, or if the container is left in place for a given amount of time, either way being without supervision by the user; the provision of such a dispenser which automatically stops dispensing if the container is removed thereby to prevent wastage; the provision of such a dispenser to dispense beer, for example, without producing undo amounts of foam; the provision of such a dispenser which can be easily lubricated with FDA approved lubricant to prevent valve sticking; the provision of such apparatus to be in kit form so existing dispensers can be retrofitted with the apparatus; the provision of such a kit which is quickly and easily installed on a dispenser; and, the provision of such apparatus and kit to be relatively inexpensive.

In accordance with the invention, generally stated, apparatus is provided for dispensing a potable beverage stored in a container. A tap is attached to the container and provides a discharge passage for the beverage. A valve opens and closes the passage. A valve control unit operates the valve. The container is a pressurized container and the valve control unit also utilizes this source of pressure to operate the valve. A controller activates the valve control unit. The controller includes a sensor for first sensing when a receptacle is positioned adjacent the tap, to activate the valve control unit, for beverage to be dispensed into the receptacle. The controller subsequently senses when the receptacle has been withdrawn to deactivate the valve control unit and stop dispensing of the beverage. The apparatus is provided as original equipment, or is available in a kit form for retrofitting existing dispensers. Further, two taps can be arranged in a side-by-side relationship for automatically dispensing beverage into two receptacles simultaneously. Other objects and features will be in part apparent and in part pointed out hereinafter.

BRIEF DESCRIPTION OF THE DRAWINGS

Corresponding reference characters indicate corresponding parts throughout the drawings.

BRIEF DESCRIPTION OF THE DRAWINGS

Figure 1:
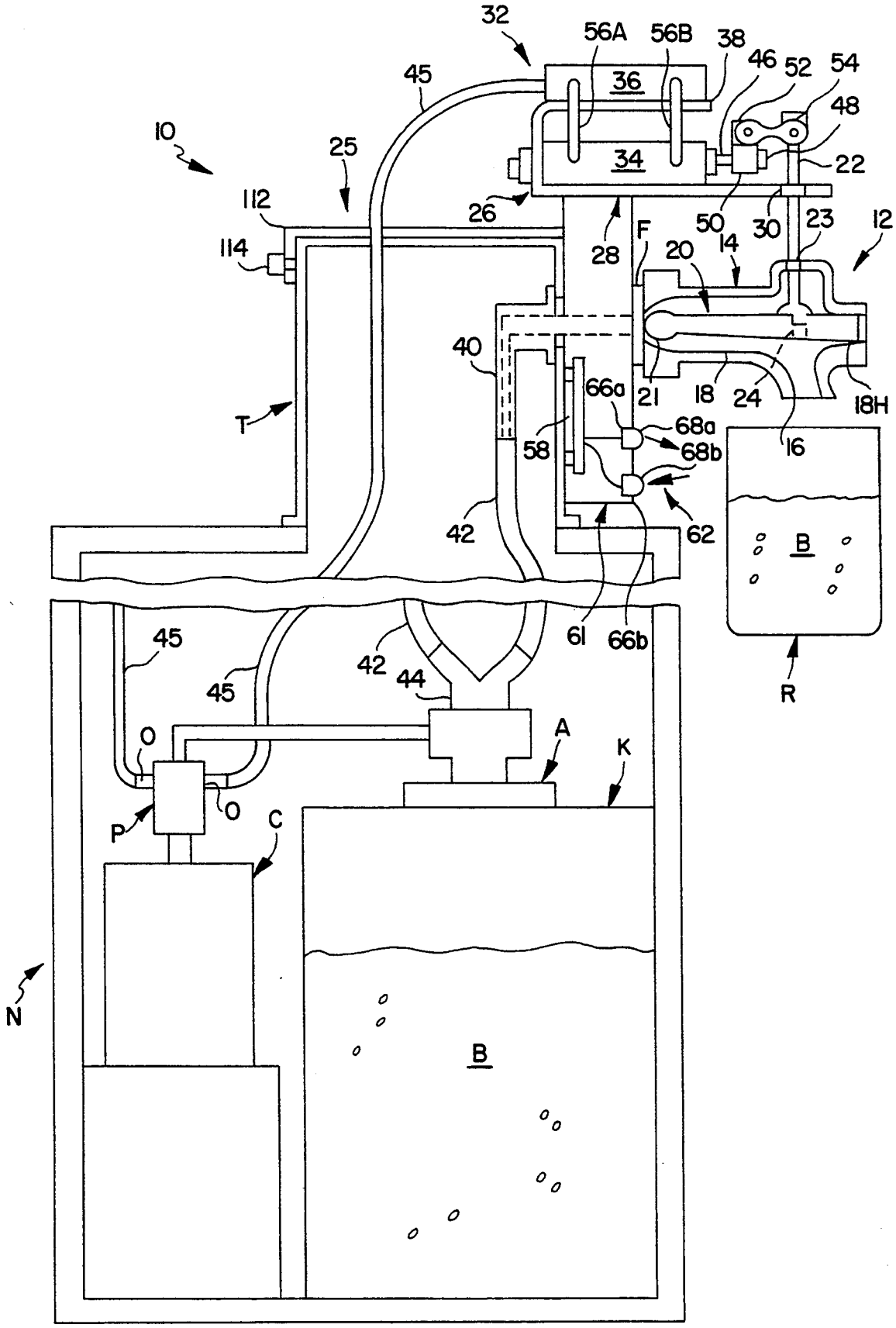
FIG. 1 illustrates a beverage dispensing apparatus of the present invention.
Figure 6:
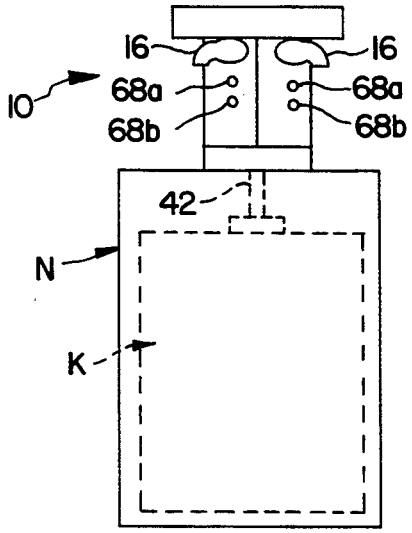
FIG. 6 illustrates the apparatus fitted to a beverage dispensing standard or tower.

Referring to the drawings, apparatus 10 of the present invention is for dispensing a potable beverage B such as beer, for example, which is stored in a half keg K as shown in FIG. 1. The keg is stored in a refrigerated cabinet N whose design and construction form no part of the invention. The apparatus is either usable as original equipment with the cabinet; or, it is supplied in kit form to retrofit existing cabinets. The cabinet is a standard unit such as is used in sports arenas, restaurants, taverns, etc. The cabinet has a tower T at its upper end through which the beverage is directed to a tap or discharge assembly for pouring the beverage into a receptacle R. An inert gas canister G is also housed in the cabinet contains an inert gas, such as $CO_2$ gas, under high pressure (800 psi). A pressure regulator attached to the outlet of the canister drops the outlet pressure of the gas to 12 psi–14 psi, and the gas is released from the canister into the keg through a pressure valve assembly A. Because the design and construction of assembly A are well-known in the art, it is not described, except to say that it is a ball valve type assembly. Apparatus 10, as is described hereinafter, functions to automatically dispense the beverage into the glass, mug, cup, or other appropriate receptacle R through a tap means 12. As shown in FIG. 6, two tap means 12 may be arranged side-by-side on tower T. This has the further advantage of allowing the user to automatically dispense beverage into two receptacles (R) at the same time. Because dispensing is automatic, it also allows the user to perform other activities at the same time. When configured as shown in FIG. 6, two of the apparatus' are also arranged in a side-by-side configuration so to be usable in dispensing beverage from both taps (16).

Apparatus 10 first includes the tap means 12 comprising a tap 14 attachable to an existing fitting F on tower T. The tap has a downwardly pointing spout 16 into which opens a beverage passage 18 extending generally horizontally through the tap. Passage 18 provides a discharge flow path for the beer stored in keg K. A valve 20 is positioned in passage 18 to normally block the passage and prevent beverage flow through the path. Valve 20 extends lengthwise of passage 18 and has a bulbous end 21 which normally seats against the fluid inlet at the fitting end of the tap. End 21 thus normally blocks the beer from flowing through the passage. Passage 18 has a horizontal extending end 18H which opens into the outer end of the tap. The outer end of valve 20 is sized to fit into this portion of the passage to seal it off, but to also permit the valve to move in a horizontal direction through this portion of the passage. A valve stem 22 extends through an opening 23 in the top of the tap. The lower end of stem 22 fits into an opening 24 in the body of valve 20 to move the valve as described hereinafter. Apparatus 10 includes mounting means 25 comprising a bracket assembly 26. A plate 28 of the bracket assembly extends parallel to and above the tap, and valve stem 22 extends upwardly through an opening 30 in the plate. To avoid valve sticking, an FDA approved lubricant should be periodically used. The lubricant is applied from the outboard side of the tap so that movement of the valve does not bring beer into contact with the lubricant. Otherwise, the beer may lose its foam.

Next, apparatus 10 includes a valve control means 32 installed on the bracket assembly for moving valve 20 to open in passage 18. Means 32 includes an air cylinder 34 and a solenoid 36 for operating the air cylinder. As seen in FIG. 1, solenoid 36 is located on an arm 38 of bracket assembly 28 directly above the air cylinder. Beer forced out of keg K by the gas and through assembly, is directed to an L-shaped adapter 40 through a tube 42. If the apparatus is used with two taps, the assembly A has a Y-shaped outlet 44 for beer to flow to each tap through one leg of the Y. Similarly, pressure regulator P has two gas outlets for pressurized gas to flow to solenoids 36 through tubes 45. Air cylinder 34 has a movable rod 46 at the outer end of which is a stop 48. A collar 50 is installed on the rod and has a projecting ear 52 to which is attached one end of a link 54. The other end of the link is attached to the upper end of valve stem 22. The pressurized gas flowing to solenoid 36 is provided by the solenoid to cylinder 34 through respective flow tubes 56A, 56B. When the solenoid is activated, flow is through one tube. When the solenoid is deactivated, flow is through the other tube.

In operation, solenoid 36 is energized, when a container R is positioned beneath the tap, to activate air cylinder 34. When activated, the air cylinder pulls rod 46 to the left as shown in FIG. 1. Movement of rod 46, in turn, causes stem 22 to push to the right, moving valve 20 to a position unblocking passage 18. Accordingly, beer is free to flow through the tap, under pressure from the gas, into the container R. Since the receptacle only has to be positioned beneath the tap to initiate dispensing, the person filling the receptacle does not have to manually operate the tap. When the container is moved away from the tap, or after a predetermined period of time, solenoid 36 is deactivated, and the cylinder drives the rod in the other direction to effect closing of passage 18 by valve 20.

Figure 2:
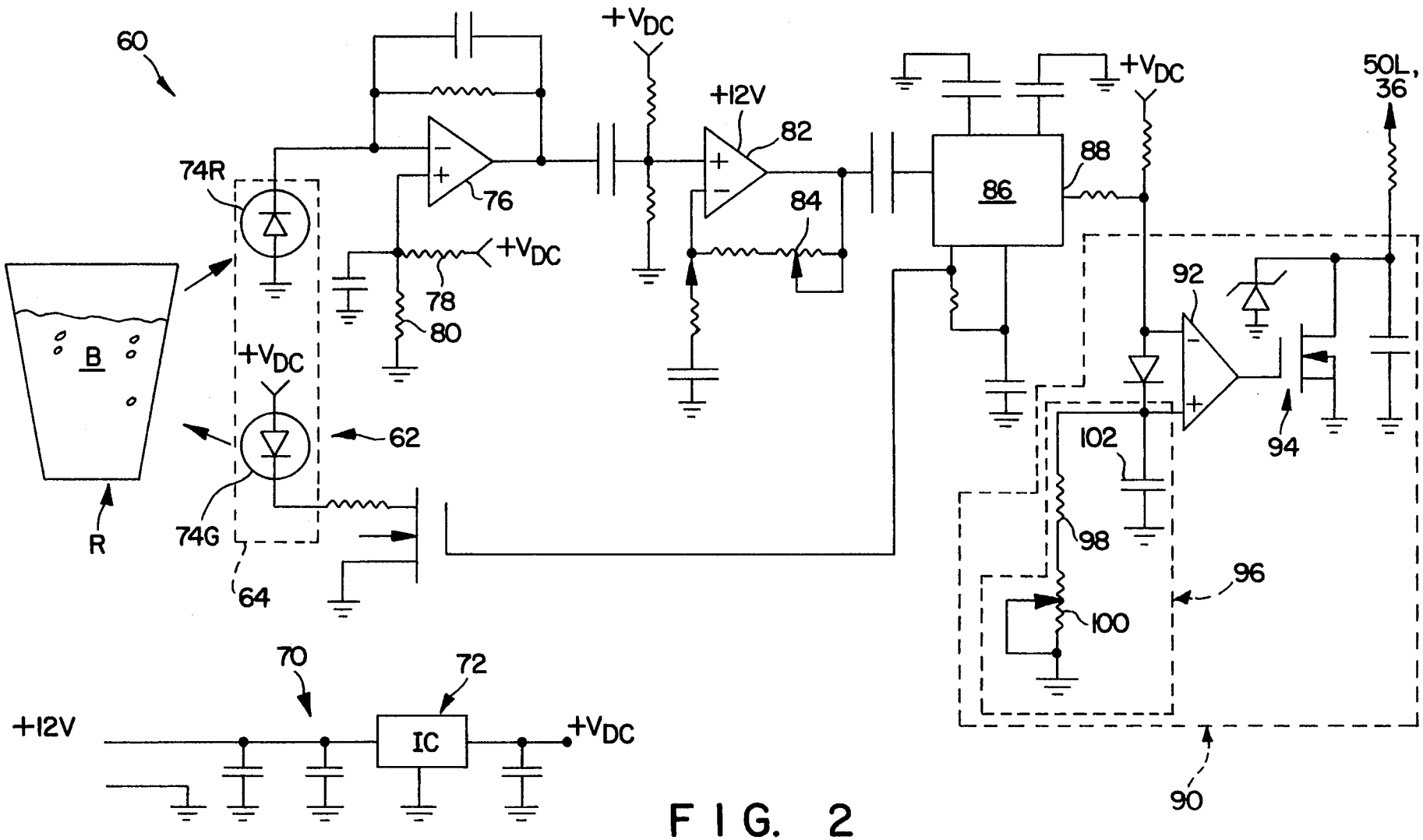
FIG. 2 is a schematic diagram of a control circuit for the apparatus.

A controller means 58 of the apparatus is housed includes a circuit board 60 installed inside a tower portion 61 of the mounting means. As shown in FIG. 2, the controller means is used to activate solenoid 36. The controller includes sensing means 62 for first sensing when receptacle R is positioned adjacent tap 12 to activate the solenoid. This effects the dispensing operation described above. The sensing means subsequently senses when the receptacle is removed, or a set period of time has elapsed, to deactivate the solenoid and stop dispensing of the beverage. Sensing means 62 comprises an infra-red, photo-optic sensor 64 mounted in tower portion 61 of the mounting means. The tower has vertically spaced openings **66*a*, 66*b* through which protrude respective lens 68*a*, 66*b* of sensor 64. Light emitted by sensor 64 is directed through lens 68*a*. Reflected light is received by the sensor through lens 68*b*. When an object such receptacle as R is placed so its mouth is beneath spout 16** of the tap, the amount of light reflected back to the sensor is considerably higher than if no object were there.

As shown in FIG. 2, a 12 V input to the controller means is first applied to a voltage control circuit 70 which includes an integrated circuit (IC) voltage controller 72 for voltage regulation. The regulated voltage output of circuit 70 is supplied to a photo-diode 74E of the sensor. Diode 74E is the emitting diode, and a photo-diode 74R is the receiving diode. The reflected light impinging upon diode 74R is converted into an electrical signal which is a function of the received reflected light energy. This output signal is applied to the inverting input of an operational amplifier (op-amp) 76 which functions as a comparator. The non-inverting input to the amplifier is provided by a voltage divider including resistors 78, 80. The output from amplifier 76 is supplied to the non-inverting input of a second op-amp 82. Op-amp 82 includes a variable resistance 84 in a feedback path for its non-inverting input. This resistor provides a sensitivity adjustment for sensor 64. The output of op-amp 82 is supplied to a tone decoder or controller 86. When the amount of reflected light increases, due to receptacle R being brought into proximity of the tap, decoder drives a demodulator pin 88 "low".

The output of demodulator pin 88 is used to control a driver circuit 90 by which solenoid 34 is activated. When pin 88 is driven low, it effectively grounds the inverting input of an op-amp 92 and causes a change in state of the output of the op-amp. The driver circuit includes a field effect transistor (FET) 94 which is driven into conduction when the output of op-amp 92 changes state. This, in turn, activates solenoid 36.

Controller means 60 shuts off the solenoid, to stop dispensing of the beverage, in one of two ways. First, if the person drawing the beverage removes the receptacle, this is sensed by sensor 64 and decoder 86 responds to the resulting change in its input signalling the removal by driving its output at pin 88 high. This in effect generates a stop command which takes FET 94 out of conduction and deactivates the solenoid. Second, controller means 60 includes a timing means 96 which functions to control the amount of time dispensing occurs. Means 96 includes a fixed resistance 98, and a variable resistance 100 which are parallel connected with a capacitor 102 to form an RC circuit whose output is provided to the non-inverting input of op-amp 92. By adjusting resistance 100, the period of time the op-amp will keep FET 94 in conduction can be varied from between 5 seconds and 15 seconds, for example. This time is variable depending upon the size of the container being filled. If receptacle R is withdrawn before the period of time set by the adjustment of resistor 100, controller 86 stops the dispensing as described above. Otherwise, means 96 will cause the non-inverting input of op-amp 92 to fall below the level of the inverting input to the op-amp. This causes the output of the op-amp to revert back to its initial state which takes FET 94 out of conduction. The time period to which the apparatus is set by adjusting resistor 100 is such that the receptacle can be left unattended while the user performs some other activity, and it will be filled to a desired level when the user returns. This greatly improves the efficiency of the user particularly at busy times when the person has to serve many customers and should not have to wait until the receptacle is filled before being able to do other things necessary to complete the service.

Figure 3:
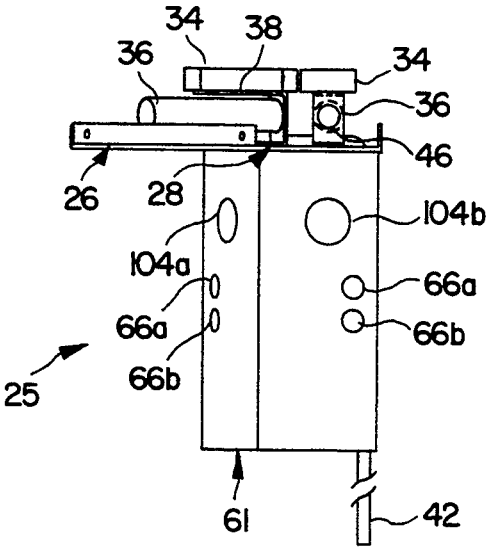
FIG. 3 is a front elevational view of a bracket assembly on which the components of the apparatus are mounted for attachment to a beverage dispenser.
Figure 4:
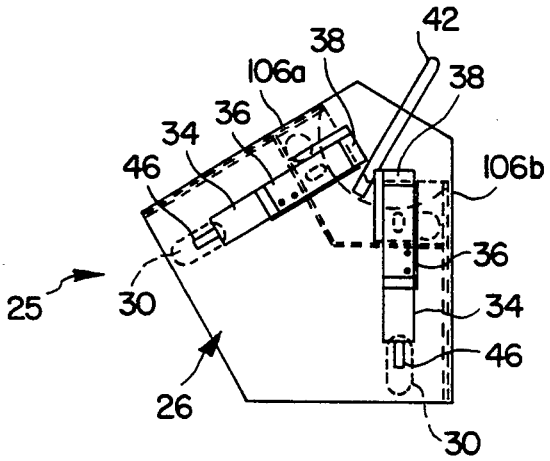
FIG. 4 is a top plan view of the assembly.
Figure 5:
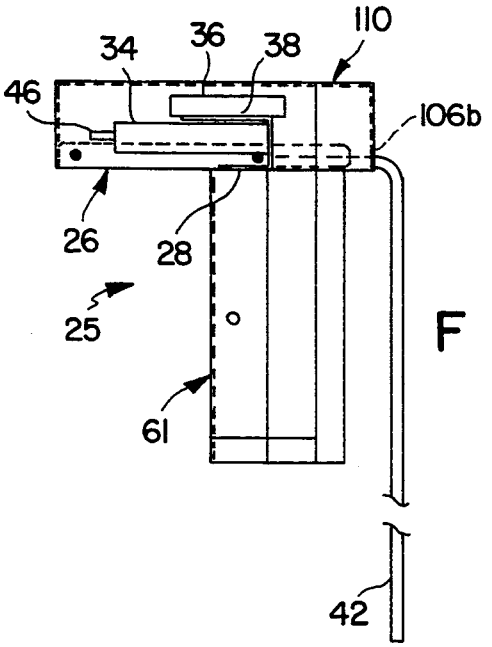
FIG. 5 is a side elevational view of the assembly.

Referring to FIGS. 3–5, mounting means 25 is shown to include the bracket assembly for the side-by-side container arrangement of FIG. 6. In this configuration, the taps are shown to be 60° apart. This is a standard arrangement for two tap dispensers. Thus, tower section 61 is shown to be V-shaped with corresponding openings 66*a*, 66*b* in each leg, together with openings 104*a*, 104*b* for the respective taps 16. Plate 28 is of a pentagonal shape, when viewed in plan, the sides of the plate being appropriately dimensioned so as to have the plate extend around toward the sides of cabinet N. Air cylinders 34 are respectively mounted parallel to sides 106*a*, 106*b* of the plate. The edges of these sides are upturned so a cover 110 (see FIG. 5) can be attached to the bracket assembly to cover the upper portion of the assembly; and in particular, the air cylinders and solenoids. Respective openings 30 are elongate openings which permit adjustment of the air cylinders relative to the tap assemblies. The cylinders are appropriately adjusted to facilitate the air cylinders moving the valve members 20 to unblock the flow passages 18 in each tap. Finally, as shown in FIG. 1, the mounting means may include a circular cover 112 which is sized to fit over the existing tower of the dispenser. The cover attaches to the existing tower by a set screw 114 or the like. This simplifies retrofitting a dispenser with the apparatus when it is supplied in kit form.

What has been described is a beverage dispensing apparatus which quickly and efficiently dispenses quantities of a beverage. The apparatus automatically dispenses the beverage and allows a user to quickly fill numerous cups, glasses, mugs, etc., without having to manually operate a tap. This saves time helps reduce operating costs. Importantly, the apparatus also dispenses the beverage without the dispenser having to be attended to by waiter, bartender, or counterperson. Thus, various sized containers can be automatically filled even if the user is busy or distracted and not attentive to the dispensing operation. The apparatus first senses when a container is positioned for filling to begin dispensing the beverage and then subsequently senses when the container is withdrawn, or has been left in place a sufficient amount of time to be filled, to automatically stop dispensing. By automatically stopping the dispensing, the user does not have to give his or her complete attention to the filling operation. The apparatus is available in kit form for quickly and easily retrofitting existing dispensers.

In view of the foregoing, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. An apparatus for dispensing a potable beverage stored in a pressurized container, the apparatus comprising:

tap means attachable to the container for providing a discharge flow path for the beverage stored therein, the tap means comprising a tap removably attachable to the beverage container;

valve means for opening and closing the discharge flow path, the valve means including a valve normally closing the discharge flow path;

a source of pressure including a gas cylinder containing an inert gas;

valve control means for operating the valve means, the valve control means utilizing said source of pressure to operate the valve means, the valve control means, when activated, moving the valve to open the path; the valve control means including a second cylinder operable by the inert gas, a solenoid through which the gas is routed to the second cylinder, and controller means for activating the valve control means, the controller means including switch means for energizing and de-energizing the solenoid and sensing means for first sensing when a receptacle is positioned adjacent the tap means to activate the valve control means for beverage to be dispensed into the receptacle and for subsequently sensing when the receptacle has been withdrawn to deactivate the valve control means and stop dispensing of the beverage.

2. An apparatus for dispensing a potable beverage from a pressurized container, the apparatus comprising:

a gas cylinder containing an inert gas to pressurize the container;

tap means, attachable to said container, for providing a discharge flow path for the beverage stored in said container;

valve means for opening and closing the discharge flow path;

valve control means for operating the valve means, the valve control means including a second cylinder operable by the inert gas;

solenoid means for routing the inert gas to said second cylinder;

controller means for activating the valve control means including a switch means for energizing and de-energizing the solenoid means; and sensing means within said controller means for first sensing when a receptacle is positioned adjacent the tap means to activate the valve control means for the beverage to be dispensed into the receptacle and for subsequently sensing when the receptacle has been withdrawn to deactivate the valve control means and stop dispensing the beverage.

3. The apparatus of claim 2 wherein the sensing means includes an optical sensor for directing a light beam at a space beneath the tap, the sensor being responsive to light reflected off a receptacle when it is positioned beneath the tap to effect actuation of the switch means and opening of the valve means.

4. The apparatus of claim 3 wherein the optical sensor is further responsive to the change in reflected light when the receptacle is withdrawn to effect deactivation of the switch means and closing of the valve means.

5. The apparatus of claim 4 further wherein the sensor is an infra-red sensor and the controller means further includes means for adjusting the sensitivity of the infra-red sensor.

6. The apparatus of claim 3 wherein the controller means further includes timing means for controlling the amount of beverage dispensed as a function of the amount of the time since the valve means has been opened.

7. The apparatus of claim 6 wherein the controller means includes a controller responsive to an indication from the optical sensor to provide a signal to the switch means to activate the solenoid when the receptacle is in place, and responsive to either an indication from the optical sensor that the receptacle has been withdrawn or that a predetermined amount of time since the valve has been opened has elapsed.

8. An apparatus for dispensing a potable beverage stored in a pressurized container comprising:

tap means attachable to the container for providing a discharge flow path for the beverage stored therein;

valve means for opening and closing the discharge flow path;

valve control means for operating the valve means, the valve control means utilizing a source of pressure by which the container is pressurized to operate the valve means;

controller means for activating the valve control means and including sensing means for first sensing when a receptacle is positioned adjacent the tap means to activate the valve control means for beverage to be dispensed into the receptacle, and for subsequently sensing when the receptacle has been withdrawn to deactivate the valve control means and stop dispensing of the beverage; and mounting means for mounting the apparatus on a housing, the mounting means including a bracket assembly attachable to said housing.

9. The apparatus of claim 8 wherein the beverage container is enclosed in said housing having a tower at its upper end through which the beverage is routed and the bracket assembly is installable on the tower.

10. The apparatus of claim 8 further including a second tap means arranged generally side-by-side with the first said tap means and the controller means controls simultaneous dispensing of beverage through both tap means.

11. An apparatus attachable to a standard potable beverage dispenser cabinet for the controlled dispensing of a beverage from a pressurized container the container being pressurized from an operatively associated source of inert gas, the apparatus comprising:

a tap, attachable to the pressurized container, including a discharge passage for the beverage contained in the container and a valve normally blocking the passage;

valve control means for moving the valve to unlock the passage, the valve control means including an air cylinder to which pressurized gas from the operatively associated gas source is directed for moving the valve;

a solenoid for operating the air cylinder;

controller means for controlling operation of the valve, the controller means including sensing means for first sensing when a receptacle is positioned adjacent the tap to operate the valve control means and cause beverage to be dispensed into the receptacle and for subsequently sensing when the receptacle is withdrawn to further operate the valve control means to stop dispensing of the beverage; and mounting means for mounting said tap, said valve control means, said solenoid, and said controller means to the dispenser cabinet.

12. The apparatus of claim 11 wherein the controller means includes a switch for energizing and de-energizing the solenoid.

13. The apparatus of claim 12 wherein the sensing means include an infra-red sensor responsive to light reflected off the receptacle when it is positioned adjacent the tap to effect energization of the switch and opening of the valve, and to a change in the light reflected by the receptacle when it is withdrawn to effect de-energization of the switch and closing of the valve.

14. The apparatus of claim 13 wherein the controller means further includes timing means for controlling the amount of beverage dispensed as a function of the amount of time since the pressurization valve has been opened.

15. The apparatus of claim 11 further including a second tap means arranged generally side-by-side with the first said tap means and the controller means controls simultaneous dispensing of beverage through both tap means.

* * * * *